US008253591B2

(12) United States Patent
Rothschild

(10) Patent No.: US 8,253,591 B2
(45) **Date of Patent: *Aug. 28, 2012**

(54) VEHICLE TRAFFIC FLOW DATA ACQUISITION AND DISTRIBUTION

(75) Inventor: Leigh M. Rothschild, Sunny Isles Beach, FL (US)

(73) Assignee: SRR Patent Holdings, LLC, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/220,010

(22) Filed: Aug. 29, 2011

(65) Prior Publication Data

US 2011/0309951 A1 Dec. 22, 2011

Related U.S. Application Data

(63) Continuation of application No. 12/234,825, filed on Sep. 22, 2008, now Pat. No. 8,009,062, and a continuation of application No. 12/907,702, filed on Oct. 19, 2010, now Pat. No. 8,031,084.

(51) Int. Cl.
*G08G 1/09* (2006.01)

(52) U.S. Cl. ..... 340/905; 340/937; 340/995.1

(58) Field of Classification Search ..... 340/905, 340/936, 937, 995.1; 701/301, 1, 23, 200
See application file for complete search history.

(56) References Cited

U.S. PATENT DOCUMENTS

| | | | | |
|---|---|---|---|---|
| 5,959,577 | A * | 9/1999 | Fan et al. | 342/357.42 |
| 6,012,012 | A * | 1/2000 | Fleck et al. | 701/117 |
| 6,297,748 | B1 * | 10/2001 | Lappenbusch et al. | 340/905 |
| 6,405,132 | B1 | 6/2002 | Breed et al. | |
| 6,442,474 | B1 | 8/2002 | Trajkovic et al. | |
| 6,985,827 | B2 | 1/2006 | Williams et al. | |
| 7,511,634 | B2 * | 3/2009 | Stehle et al. | 340/905 |
| 7,751,945 | B2 | 7/2010 | Obata | |
| 8,009,062 | B2 * | 8/2011 | Rothschild | 340/905 |
| 2005/0248469 | A1 | 11/2005 | DeKock et al. | |
| 2010/0073195 | A1 | 3/2010 | Rothschild | |
| 2011/0032120 | A1 | 2/2011 | Rothschild | |

* cited by examiner

*Primary Examiner* — Anh V La
(74) *Attorney, Agent, or Firm* — Cuenot, Forsythe & Kim, LLC

(57) ABSTRACT

Embodiments of the present invention provide a method, system and computer program product for vehicle traffic flow data acquisition and reporting for onboard vehicle navigation. In an embodiment of the invention, a method for vehicle traffic flow data acquisition and reporting for onboard vehicle navigation can include acquiring imagery of multiple vehicles traveling on a roadway between two locations and individually identifying the different vehicles in the imagery. An elapsed time of travel can be determined for the individually identified vehicles between the two locations and a rate of travel can be computed for each of the individually identified different vehicles based upon the elapsed time of travel. Thereafter, the rate of travel for at least one of the individually identified different vehicles can be broadcast to a subscriber for at least one of the two locations.

22 Claims, 2 Drawing Sheets

VEHICLE TRAFFIC FLOW DATA ACQUISITION AND DISTRIBUTION

CROSS-REFERENCE TO RELATED APPLICATIONS

This application is a Continuation of U.S. application Ser. No. 12/234,825, filed on Sep. 22, 2008, and this application is related to U.S. application Ser. No. 12/907,702, filed on Oct. 19, 2010, and incorporated herein in its entirety.

BACKGROUND OF THE INVENTION

1. Field of the Invention

The present invention relates to the field of real-time traffic conditions broadcasting and more particularly to real-time traffic condition reporting for Internet connected onboard navigation.

2. Description of the Related Art

The explosion of vehicle usage in the United States more than a half-century ago has brought tremendous benefit to the ordinary citizen. The advent of the interstate highway system now enables individuals to travel great distances at high speeds in short periods of time. The ease of travel afforded by the automobile and interstate highway system, however, is not without consequence. For most Americans, traffic has become a part of life and a daily annoyance. Indeed, the presence and anticipation of traffic affects ordinary citizens every day in planning travel and the timing of meetings with others.

For several decades, broadcast media adopted the responsibility of traffic conditions reporting over the airwaves such that listeners and viewers could more ably plan travel routing. Though traffic reports historically have been provided only at periodic intervals, given enough advance warning, savvy travelers could plan alternate routing responsive to the reporting of a traffic condition present at a portion of a planned route. Notwithstanding, planning an alternate route remained highly dependant on both the timing of the receipt of a traffic condition report and the knowledge of the traveler of an alternative route.

Global positioning system (GPS) technologies afford a tremendous leap forward in respect to onboard vehicle navigation and traffic condition avoidance. GPS technologies now can be found as standard equipment in many vehicles and provide the previously absent guarantee of alternate routing knowledge for drivers. Current GPS technologies further integrate with over-the-air broadcasting of real-time traffic conditions utilizing Internet connectivity so that drivers can correlate traffic conditions in real-time along a proposed route of travel.

Not all traffic conditions reported through broadcast traffic reports reflect a complete standstill of traffic. Rather, in most circumstances, traffic flows in an area of congestion—just not at a high rate of speed. Travelers with advance knowledge of congestion along a planned route make alternate routing decisions based upon the nature of traffic flow. So long as traffic flows at an acceptable speed, albeit not an optimal speed, travelers are less likely to prefer an alternate route. Knowing the rate of speed of traffic in a congested area, however, requires the traveler to rely upon the estimates of real-time broadcast reports over the radio over television resulting from personally observed traffic speeds (typically by helicopter or live camera feed).

Recent proposals in Internet connected GPS navigation technologies further provide for the reporting of the nature of traffic—namely the speed at which vehicles travel in an area of congestion. Those recent proposals incorporate community participation in reporting the flow of traffic in an accurate manner. In this regard, vehicles experiencing congestion can report a contemporaneous speed and present location to a centralized server. The centralized server can aggregate reported speeds and locations to provide an accurate picture of the flow of traffic at different geographic locations that can be subsequently broadcast over the air to Internet connected onboard GPS navigation systems. It will be recognized by the skilled artisan, however, that accurate reporting of the flow of traffic at a given geographic location requires enough vehicles reporting respective rates of travel in order to result in statistically relevant data.

BRIEF SUMMARY OF THE INVENTION

Embodiments of the present invention address deficiencies of the art in respect to broadcasting real-time traffic conditions along a route of travel and provide a novel and non-obvious method, system and computer program product for vehicle traffic flow data acquisition and reporting for onboard vehicle navigation. In an embodiment of the invention, a method for vehicle traffic flow data acquisition and reporting for onboard vehicle navigation can include acquiring imagery of multiple vehicles traveling on a route of travel between two locations, such as a highway, byway or waterway, and individually identifying the different vehicles in the imagery. An elapsed time of travel can be determined for the individually identified vehicles between the two locations and a rate of travel can be computed for each of the individually identified different vehicles based upon the elapsed time of travel. Thereafter, the rate of travel for at least one of the individually identified different vehicles can be broadcast to a subscriber for at least one of the two locations.

In another embodiment of the invention, an onboard vehicle navigation data distribution data processing system can be configured for vehicle traffic flow data acquisition and reporting. The system can include cameras positioned at locations along a route of travel such as a highway, byway or waterway, and at least one image acquisition and detection system coupled to the cameras. The image acquisition and detection system can be configured to acquire imagery of vehicles passing along the roadway, to identify individual ones of the vehicles in the acquired imagery and to determine an elapsed time of travel for each of the individual ones of the vehicles between two of the cameras. A traffic flow data store also can be communicatively coupled to each of the cameras. The data store can store rates of travel for the individual ones of the vehicles for different based upon the elapsed time of travel for the individual ones of the vehicles at different ones of the locations.

Finally, traffic flow computation logic can be coupled to the traffic flow data store. The logic can include program code enabled to broadcast a rate of travel for at least one of the individually ones of the vehicles to a subscriber for a selected one of the locations. In one aspect of the embodiment, the program code can be further enabled to broadcast acquired imagery for a selected one of the locations to the subscriber. In another aspect of the embodiment, the program code can be further enabled to broadcast an average rate of travel for the vehicles to a subscriber for a selected one of the locations. Finally, in even yet another aspect of the embodiment, the program code can be further enabled to broadcast the rate of travel for at least one of the individual ones of the vehicles to a subscriber for a selected one of the locations only when the selected one of the locations is within a planned route of travel for the subscriber.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the present invention provide a method, system and computer program product for vehicle traffic flow data acquisition and reporting for onboard vehicle navigation. In accordance with an embodiment of the present invention, multiple different imaging systems can be placed individually at different locations along a route of travel, such as a highway, byway or waterway. Images of different vehicles can be captured at each of the locations and different ones of the different vehicles can be image recognized. A time of travel between pairs of the locations can be determined for selected ones of the different vehicles in order to compute a rate of travel for the selected ones of the different vehicles. The resulting rates of travel between pairs of the locations can be aggregated to produce an estimate of traffic flow between each of the pairs of the locations. The estimate in turn can be broadcast to vehicles traveling along a route incorporating any one of the pairs of the locations. Optionally, imagery captured by the imaging systems at a selected one of the pairs of the locations further can be transmitted to the vehicles to provide a visual cue of traffic conditions between the selected one of the pairs of the locations.

Figure 1:
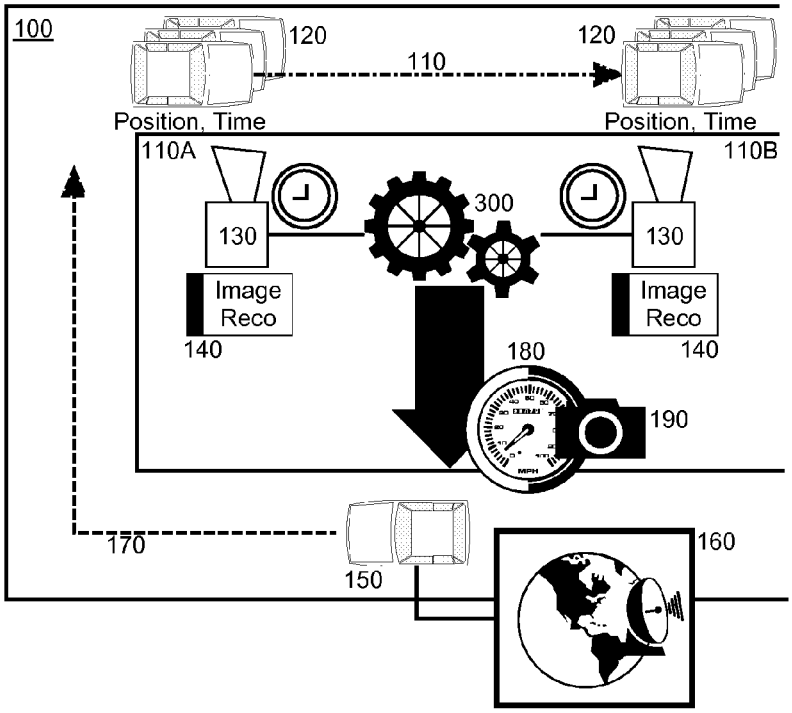
FIG. 1 is a schematic illustration of a process for vehicle traffic flow data acquisition and reporting for onboard vehicle navigation.

In further illustration, FIG. 1 is a schematic illustration of a process for vehicle traffic flow data acquisition and reporting for onboard vehicle navigation. As shown in FIG. 1 with respect to specifically to a roadway, imaging systems 130 can be placed at different locations 110A, 110B of a road 100. Imaging systems 130 can acquire imagery of vehicles 120 passing through the location 110A, 110B and different ones of the vehicles 120. The imagery can include individual images, or a collection of images in video imagery. Image recognizer 140 can identify individual ones of the vehicles 120 such that an elapsed time between the identified individual ones of the vehicles 120 in the captured imagery at the different locations 110 can be used to determine a rate of travel (speed) for each of the identified individual ones of the vehicles 120.

Thereafter, for a vehicle 150 projected to travel along a route 170 passing through the locations 110A, 110B can retrieve the rate of travel 180 for multiple different ones of the vehicles 120 in order to identify a degree of congestion between the locations 110A, 110B. Further, imagery 190 of one or more of the locations 110A, 110B can be provided to the vehicle 150. In this regard, both the rate of travel 180 and the imagery 190 can be provided to the vehicle 150 through an Internet connected onboard navigation system 160. Alternatively, the rate of travel 180 can be provided to a subscriber in the vehicle 150 through text messaging, Web page, or by way of e-mail. As yet another alternative, the rate of travel 180 can be provided to the subscriber in the vehicle 150 only when the rate of travel 150 falls below a threshold value (essentially an alert to unacceptable traffic congestion). Finally, as even yet another alternative, a precise location of the location 110B can be provided to the subscriber in the vehicle 150, for example in terms of latitude and longitude values.

Figure 2:
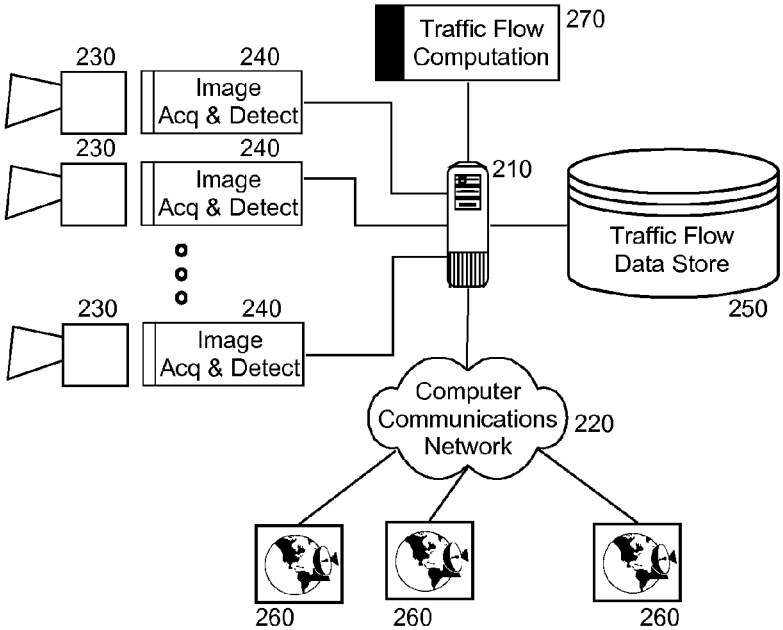
FIG. 2 is a schematic illustration of an onboard vehicle navigation data distribution data processing system configured for vehicle traffic flow data acquisition and reporting; and, FIGS. 3A and 3B, taken together, are a flow chart illustrating a process for vehicle traffic flow data acquisition and reporting for onboard vehicle navigation.

The process described in connection with FIG. 1 can be employed in an onboard vehicle navigation data distribution data processing system. In further illustration, FIG. 2 schematically depicts an onboard vehicle navigation data distribution data processing system configured for vehicle traffic flow data acquisition and reporting. The system can include a host server 210 communicatively coupled to multiple different image acquisition systems 230, each including an image acquisition and detection system 240. The host server 210 can host the execution of traffic flow computation logic 270. The traffic flow computation logic 270 can include program code enabled to compute a rate of travel for different vehicles at a location based upon a duration of travel between pairs of the image acquisition systems 230. The program code further can be enabled to store the rate of travel in connection with each vehicle and a corresponding location within coupled traffic flow data store 250.

Multiple different Internet connected onboard navigation systems 260 can be communicatively coupled to host server 210 over computer communications network 220. Consequently, rates of travel for relevant locations along a planned route in the different ones of the onboard navigation systems 260 can be provided to end users through respective ones of the onboard navigation systems 260. Further, imagery of locations along a planned route in the different ones of the onboard navigation systems 260 can be provided to end users through respective ones of the onboard navigation systems 260. The imagery can be provided at the request of an end user through the selection of an icon in a user interface in a corresponding one of the onboard navigation systems 260 at the location along the planned route. Yet further, current weather conditions acquired for the relevant locations along a planned route can be provided to the different ones of the onboard navigations systems 260.

Figure 3A:
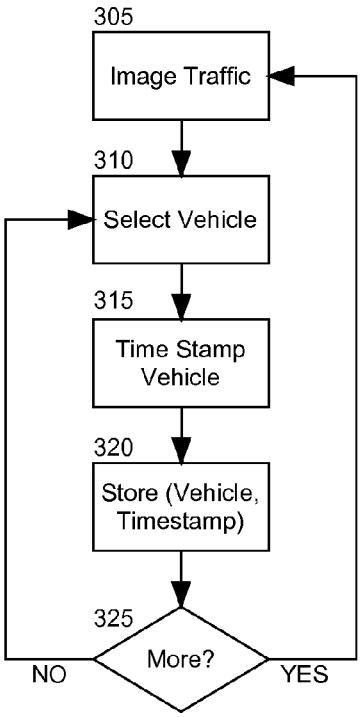
Figure 3B:
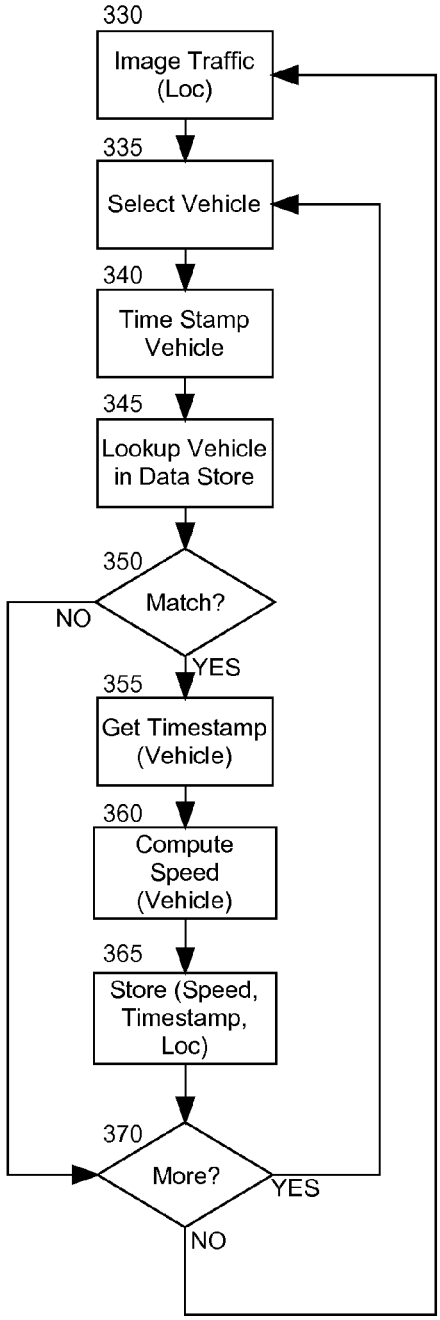

In yet further illustration of the operation of the traffic flow computation logic 270, FIGS. 3A and 3B, taken together, are a flow chart illustrating a process for vehicle traffic flow data acquisition and reporting for onboard vehicle navigation. Beginning in block 305 of FIG. 3A, traffic can be imaged at a first point in a route along a roadway. In block 310, a first vehicle in the image can be selected and time stamped in block 315 to record a time of acquiring the image. In block 320, the time stamp can be stored in connection with the selected vehicle and, in decision block 325, if additional vehicles remain to be time stamped in the image, the process can repeat in block 310. Otherwise, a new image can be acquired in block 305 and the process can continue as before through block 310.

Turning now to FIG. 3B, in block 330 traffic can be imaged at a subsequent point in the route along the roadway. In block 335, a first vehicle in the image can be selected and time stamped in block 340 to record a time of acquiring the image. In block 345, the vehicle can be compared to a data store of vehicles to determine whether a time stamp had been previously recorded for the vehicle at the first point in the route. In decision block 350, if a match is found, in block 355 the previously stored time stamp for the vehicle can be retrieved and in block 360 a rate of travel can be computed for the vehicle based upon the known distance between the points in the route and the duration of time taken by the vehicle to travel between the points according to the stored time stamp and the time stamp applied in block 340.

Thereafter, in block 365 the rate of travel can be recorded in connection with the subsequent point in the route and the time of acquiring the image at the subsequent point in the route. In decision block 370, if rates of travel for additional vehicles remain to be computed, the process can repeat in block 335 with the selection of a next vehicle in the image. Otherwise, a new image can be acquired at the subsequent point in the route in block 330.

Of note, by acquiring a multitude of rates of travel for the subsequent point in the route, an average rate of travel can be computed for the subsequent point in the route for a given range of time or for a given moment in time. The average rate of travel can be communicated to inquiring vehicles anticipating travel through the subsequent point in the route along with relevant imagery of the subsequent point in the route. Consequently, an accurate characterization of congestion for a location in a route of travel can be communicated in real time to inquiring travelers through an Internet connected onboard navigation system.

Embodiments of the invention can take the form of an entirely hardware embodiment, an entirely software embodiment or an embodiment containing both hardware and software elements. In a preferred embodiment, the invention is implemented in software, which includes but is not limited to firmware, resident software, microcode, and the like. Furthermore, the invention can take the form of a computer program product accessible from a computer-usable or computer-readable medium providing program code for use by or in connection with a computer or any instruction execution system.

For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

I claim:

1. A data acquisition and distribution hardware system for distributing information about a measured route of travel, comprising:

an image detection hardware system configured to:

receive, from a first camera positioned at a beginning of the measured route of travel, imagery of a plurality of vehicles at a first location, receive, from a second camera positioned at an end of the measured route of travel, imagery of a plurality of vehicles at a second location, individually identify different vehicles in both the first and second imagery, calculate a rate of travel for each of the individually identified vehicles based upon the first imagery and the second imagery; and a broadcasting system configured to:

broadcast information about the measured route of travel to an onboard vehicle navigation system of a subscriber.

2. The hardware system of claim 1, wherein the image detection hardware system is further configured to:

calculate an elapsed time of travel along the measured route of travel for each of the individually identified vehicles, and calculate an average rate of travel along the measured route of travel over a predetermined period of time.

3. The hardware system of claim 1, wherein the information identifies the route of travel and an average rate of travel along the measured route of travel.

4. The hardware system of claim 3, wherein the average rate of travel is broadcast only when the average rate of travel falls below a threshold value.

5. The hardware system of claim 3, wherein the average rate of travel is broadcast to the subscriber only when a subscriber-planned route of travel in the onboard navigation system includes the measured route of travel.

6. The hardware system of claim 3, wherein the average rate of travel is displayed on the onboard vehicle navigation system of the subscriber.

7. The hardware system of claim 1, wherein the information includes at least one of the first and second locations.

8. The hardware system of claim 1, wherein the information includes a weather report for the predetermined route of travel.

9. The hardware system of claim 1, wherein the broadcasting system uses one of text messaging and e-mail to broadcast the information to the onboard vehicle navigation system.

10. The hardware system of claim 1, wherein the predetermined route of travel is along a roadway.

11. The hardware system of claim 1, wherein the predetermined route of travel is along a waterway.

12. A method for distributing information about a measured route of travel using a data acquisition and distribution hardware system, comprising:

receive, from a first camera positioned at a beginning of the measured route of travel, imagery of a plurality of vehicles at a first location, receiving, from a second camera positioned at an end of the measured route of travel, imagery of a plurality of vehicles at a second location, individually identifying different vehicles in both the first and second imagery, calculating a rate of travel for each of the individually identified vehicles based upon the first imagery and the second imagery; and broadcasting information about the measured route of travel to an onboard vehicle navigation system of a subscriber.

13. The method of claim 12, further comprising calculating an elapsed time of travel along the measured route of travel for each of the individually identified vehicles, and calculating an average rate of travel along the measured route of travel over a predetermined period of time.

14. The method of claim 12, wherein the information identifies the route of travel and an average rate of travel along the measured route of travel.

15. The method of claim 14, wherein the average rate of travel is broadcast only when the average rate of travel falls below a threshold value.

16. The method of claim 14, wherein the average rate of travel is broadcast to the subscriber only when a subscriber-planned route of travel in the onboard navigation system includes the measured route of travel.

17. The method of claim 14, wherein the average rate of travel is displayed on the onboard vehicle navigation system of the subscriber.

18. The method of claim 12, wherein the information includes at least one of the first and second locations.

19. The method of claim 12, wherein the information includes a weather report for the predetermined route of travel.

20. The method of claim 12, wherein the information is broadcast to the onboard vehicle navigation system using one of text messaging and e-mail.

21. The method of claim 12, wherein the predetermined route of travel is along a roadway.

22. The method of claim 12, wherein the predetermined route of travel is along a waterway.

* * * * *